US010371166B2

(12) United States Patent
Urac et al.

(10) Patent No.: US 10,371,166 B2
(45) Date of Patent: Aug. 6, 2019

(54) STATOR VANE SEAL ARRANGEMENT FOR A GAS TURBINE ENGINE

(71) Applicant: PRATT & WHITNEY CANADA CORP., Longueuil (CA)

(72) Inventors: Tibor Urac, Mississauga (CA); Bernadette Mason, Milton (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 322 days.

(21) Appl. No.: 15/381,420

(22) Filed: Dec. 16, 2016

(65) Prior Publication Data

US 2018/0172026 A1 Jun. 21, 2018

(51) Int. Cl.

| | |
|---|---|
| ***F04D 29/54*** | (2006.01) |
| ***F04D 29/08*** | (2006.01) |
| ***F04D 29/64*** | (2006.01) |
| ***F01D 9/04*** | (2006.01) |
| ***F01D 11/00*** | (2006.01) |

(52) U.S. Cl.

CPC ..... *F04D 29/542* (2013.01); *F01D 9/042* (2013.01); *F01D 11/005* (2013.01); *F04D 29/083* (2013.01); *F04D 29/644* (2013.01); *F05D 2220/32* (2013.01); *F05D 2300/121* (2013.01); *F05D 2300/43* (2013.01); *F05D 2300/501* (2013.01)

(58) Field of Classification Search

CPC .... F04D 29/542; F04D 29/083; F04D 29/644; F01D 9/042; F01D 11/005; F05D 2220/32; F05D 2300/121; F05D 2300/43; F05D 2300/501

USPC ..... 415/209.3

See application file for complete search history.

(56) References Cited

U.S. PATENT DOCUMENTS

| | | | | |
|---|---|---|---|---|
| 6,619,917 | B2 | 9/2003 | Glover et al. | |
| 7,980,813 | B2 | 7/2011 | Medynski et al. | |
| 8,622,692 | B1 * | 1/2014 | Liang | F01D 9/042 415/115 |
| 9,587,502 | B2 | 3/2017 | Davis | |
| 9,988,919 | B2 | 6/2018 | Davis et al. | |
| 10,233,764 | B2 | 3/2019 | Thomas et al. | |
| 2018/0171809 | A1 | 6/2018 | Urac et al. | |
| 2018/0172026 | A1 | 6/2018 | Urac et al. | |

FOREIGN PATENT DOCUMENTS

| | | | |
|---|---|---|---|
| EP | 1762703 | B1 | 3/2007 |

* cited by examiner

*Primary Examiner* — Mahmoud Gimie

(74) *Attorney, Agent, or Firm* — Norton Rose Fulbright Canada LLP

(57) ABSTRACT

A seal spacer for a gas turbine engine to provide sealing between a casing wall and a stator vane of the engine. The seal spacer comprises a circumferential body having a slot defined therethrough and configured to receive the stator vane therein. The circumferential body is configured to be disposed between and space apart the engine casing wall from a head of the stator vane when the vane is inserted in the slot and the vane is inserted in the opening in the casing wall. The circumferential body includes a support positioned to be engage and provide a gap between the casing wall and the head when the seal spacer is installed therebetween, and an elastomeric seal portion positioned to engage and compressingly provide sealing the casing wall and the head when the seal spacer is installed therebetween to seal the gap.

20 Claims, 4 Drawing Sheets

STATOR VANE SEAL ARRANGEMENT FOR A GAS TURBINE ENGINE

TECHNICAL FIELD

The application relates generally to gas turbine engines and, more particularly, to insertable stator vanes.

BACKGROUND OF THE ART

Gas turbine engines, more particularly turbofan engines, comprises a fan case, an engine core, and an annular flow passage disposed therebetween. Vanes are typically used to reduce or increase the swirl in the air flow within the engine. The vanes may be individually radially insertable into corresponding slots in the case, at their desired location, such as inside the fan case within the annular gas flow passage.

To minimize air leakage between the inserted vane and the case, a grommet may be disposed between the surface of the case and the vane head. However, the grommet may deform, causing retention system relaxation due to elastomer compression set, which may then require field maintenance to tighten the retention system, such as a circumferential strap, holding the vanes to make sure vanes remain properly loaded.

SUMMARY

In one aspect, there is provided a seal spacer for a gas turbine engine, for providing sealing between a casing wall of the engine and a stator vane inserted into a corresponding opening provided in the casing wall of the engine, the seal spacer comprising a circumferential body having a slot defined therethrough configured to receive the stator vane therein, the circumferential body configured to be disposed between and space apart the engine casing wall from a head of the stator vane when the vane is inserted in the slot and the vane is inserted in the opening in the casing wall, the circumferential body defining a first surface adapted to sealingly engage the head of the stator vane and a second surface adapted to sealingly engage the casing wall when the vane is inserted in the slot and the vane is inserted in the opening in the casing wall, wherein the circumferential body includes a support positioned to be engage and provide a gap between the casing wall and the head when the seal spacer is installed therebetween, and wherein the circumferential body includes an elastomeric seal portion positioned to engage and compressingly provide sealing the casing wall and the head when the seal spacer is installed therebetween to seal the gap.

In a another aspect, there is provided a stator vane assembly for a gas turbine engine, the gas turbine engine comprising an annular casing wall portion defining a duct and having a plurality of openings circumferentially defined therein, the stator vane assembly comprising a plurality of stator vanes configured to extend across the duct, each one of the plurality of stator vanes having a head at a radially outer end thereof and configured to protrude through a respective one of the plurality of openings between the casing wall portion and the head, the head extending along a transverse direction relative to a corresponding one of the plurality of stator vanes; and a seal spacer sealingly disposed in the gap between the casing wall portion and the head of a corresponding one of the plurality of stator vanes, the seal spacer having a slot defined therethrough to receive the corresponding one of the plurality of stator vanes, the seal spacer including a plastomeric support portion disposed between the casing wall and the head, the plastomeric support portion being configured and sized to define a gap between the head and the casing wall portion, an elastomeric seal portion extending laterally from the plastomeric support portion and being compressingly disposed between the casing wall portion and the head thereby sealing the gap.

In a further aspect, there is provided a method for sealing a gap defined between a casing wall and a head of a stator vane of a gas turbine engine, the method comprising disposing a seal spacer within the gap, the seal spacer comprising a plastomeric support portion and an elastomeric seal portion; sealingly contacting a radially outer surface of the seal spacer with an inner surface of the head; and sealingly contacting a radially inner surface of the seal spacer with an outer surface of the casing wall.

DESCRIPTION OF THE DRAWINGS

Reference is now made to the accompanying figures in which.

DETAILED DESCRIPTION

Figure 1:
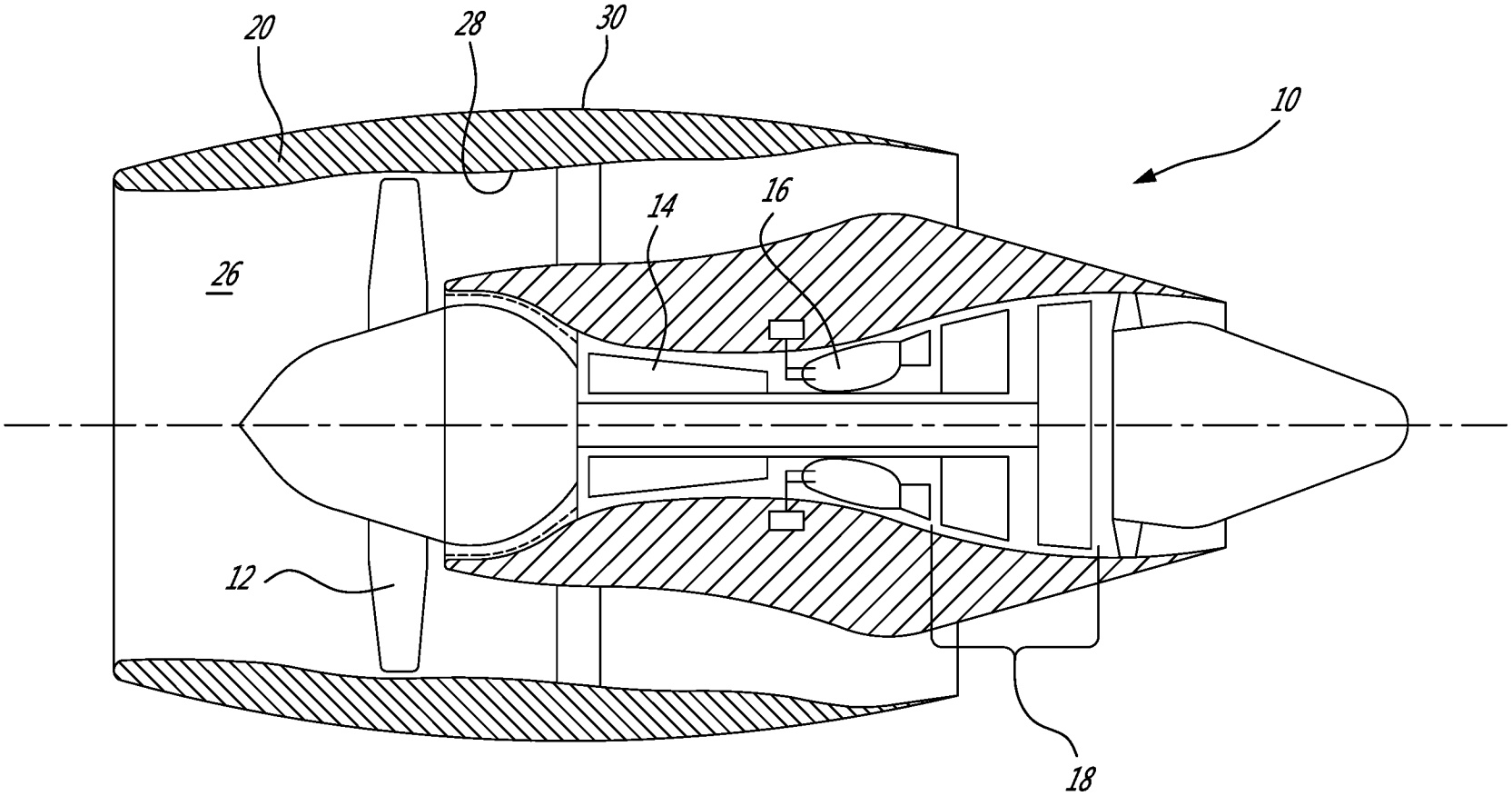
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. A casing wall 20 surrounds the fan 12 and other components of the engine 10.

Figure 2:
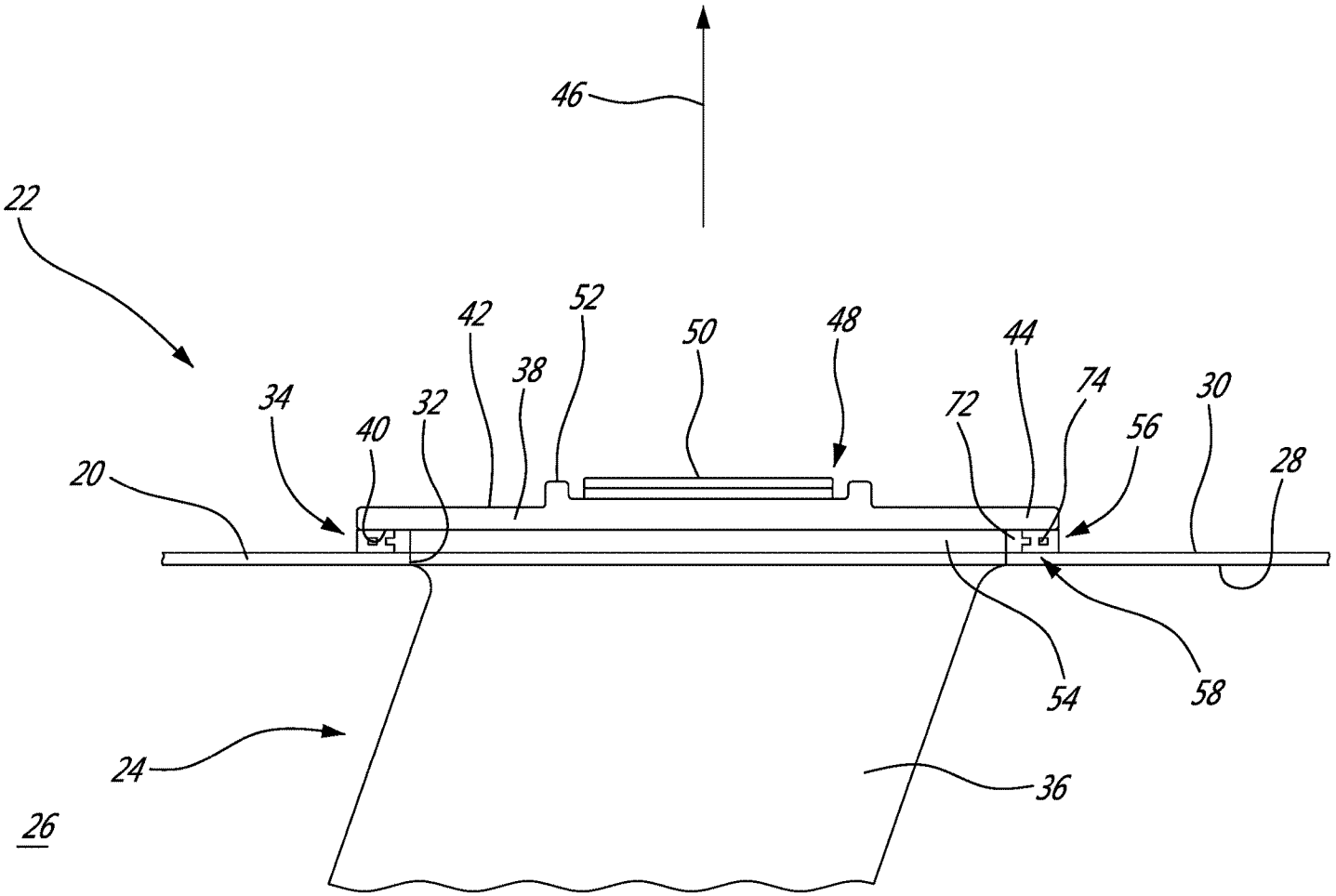
FIG. 2 is a cross-sectional view of a stator vane assembly mounted on a casing wall of the engine shown in FIG. 1.

Referring to FIG. 2, a stator vane assembly 22, which can be disposed for example downstream of the fan 12 (shown in FIG. 1) or a low pressure compressor, is shown. In the particular embodiment shown, the stator vane assembly 22 includes by-pass stator vanes 24 which are surrounded by the casing wall 20. In the embodiment shown, the casing wall 20 defines an annular by-pass flow path or duct 26 such that air enters the engine 10 through an upstream front end of the casing wall 20 and is accelerated downstream by the fan 12. In the embodiment shown, the casing wall 20 is a fan case. Alternately, the casing wall 20 can be any suitable casing of the engine 10, such as a casing of the compressor section 14. The casing wall 20 has an inner case surface 28 delimiting the flow path and an opposite outer case surface 30. Vane-receiving openings 32 are defined through the casing wall 20 and are circumferentially distributed about the circumference of the casing wall 20. The stator vanes 24 may extend radially across the duct 26 through the vane-receiving openings 32. In a particular embodiment, each stator vane 24 may have a tip region 34 retained by the casing wall 20, a root region retained in an inner shroud (not shown) and an airfoil portion 36 extending therebetween.

The tip region 34 of the stator vane 24 includes a head 38 at a radially outer end thereof outside of the duct 26. In the embodiment shown, the head 38 is a platform extending along the casing wall 20. The head 38 can have any suitable platform shape. The head 38 defines an inner pressure surface 40 facing the opposite outer case surface 30 of the casing wall 20 when the vane 24 is assembled to the casing wall 20, and an opposite outer surface 42. In an embodiment, the head 38 defines a flange 44 projecting along a generally transverse direction relative to a radial direction 46 of the vane 24. The outer surface 42 may include a strap holder 48 for receiving a corresponding fastening strap 50 or other member used to fasten and retain the vanes 24 in place within the casing wall 20. In the particular embodiment shown, the strap holder 48 includes two elongated and axially spaced apart fingers 52 extending radially outwardly from the outer surface 42. In an alternate embodiment, the strap holder 48 is in the form of a circumferential groove or passage defined in the outer surface 42. The head 38 may also be without a strap holder 48, relying on friction instead and/or on strap holders on the casing wall 20.

The tip region 34 of the vane 24 may include a neck 54 extending inwardly from the inner pressure surface 40 of the head 38, and connected to the airfoil portion 36. The neck 54 is received and retained in the vane-receiving opening 32. The vane-receiving opening 32 has a shape generally corresponding the shape of the neck 54, while being configured such that the head 38 of the corresponding vane 24 is prevented from passing therethrough. The neck 54 may protrude from the outer case surface 42 such that a gap 56 is defined between the outer case surface 42 and the inner pressure surface 40.

Figure 3A:
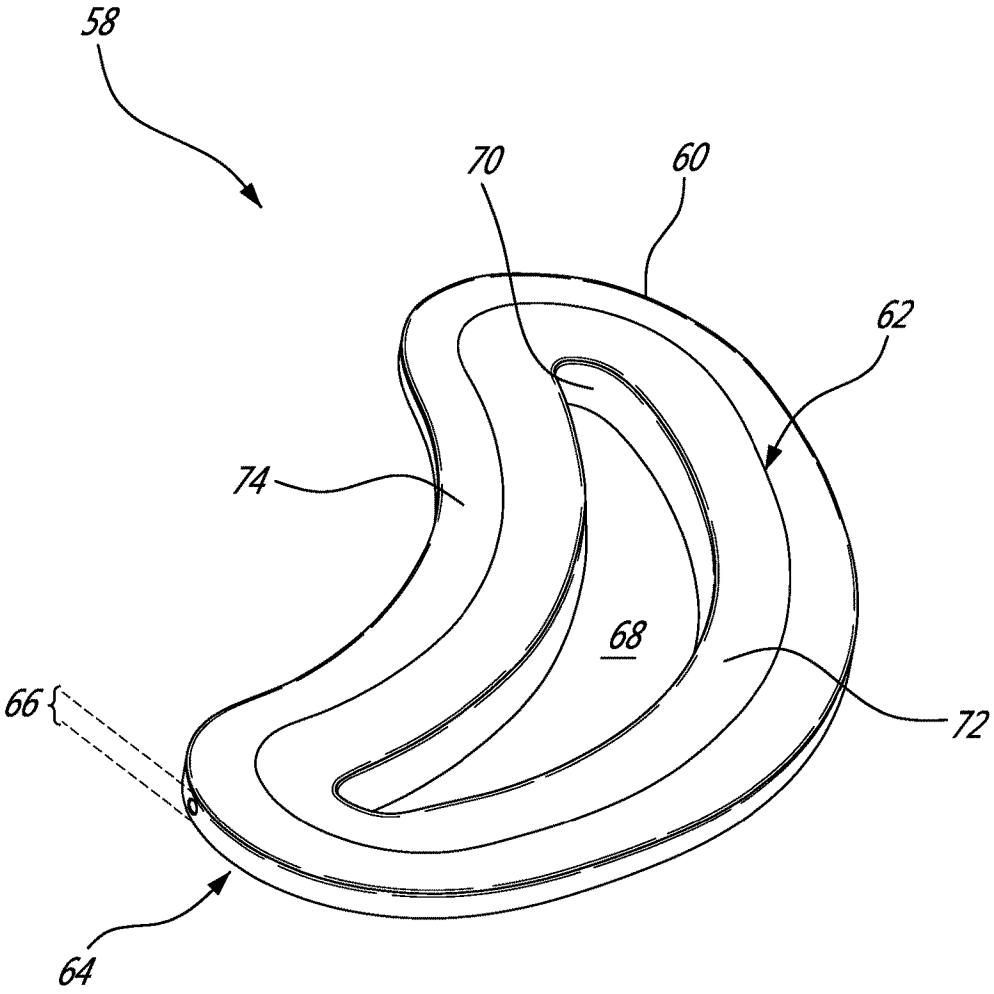
FIG. 3A is a perspective view of a seal spacer used in the stator vane assembly in accordance to a particular embodiment.

A seal spacer 58 is disposed in the gap 56 to provide sealing between the inner pressure surface 40 of the head 38 and the outer surface 42 of the casing wall 20, and a structural connection as well. Referring to FIG. 3A, the seal spacer 58 has a circumferential body 60 defining a radially outer surface 62 adapted to sealingly engage the inner pressure surface 40 of the head 38, and a radially inner surface 64 adapted to sealingly engage the outer surface 30 of the casing wall 20 around the vane-receiving opening 32. A thickness 66 of the seal spacer 58 is defined between the outer surface 62 and the inner surface 64.

Figure 3B:
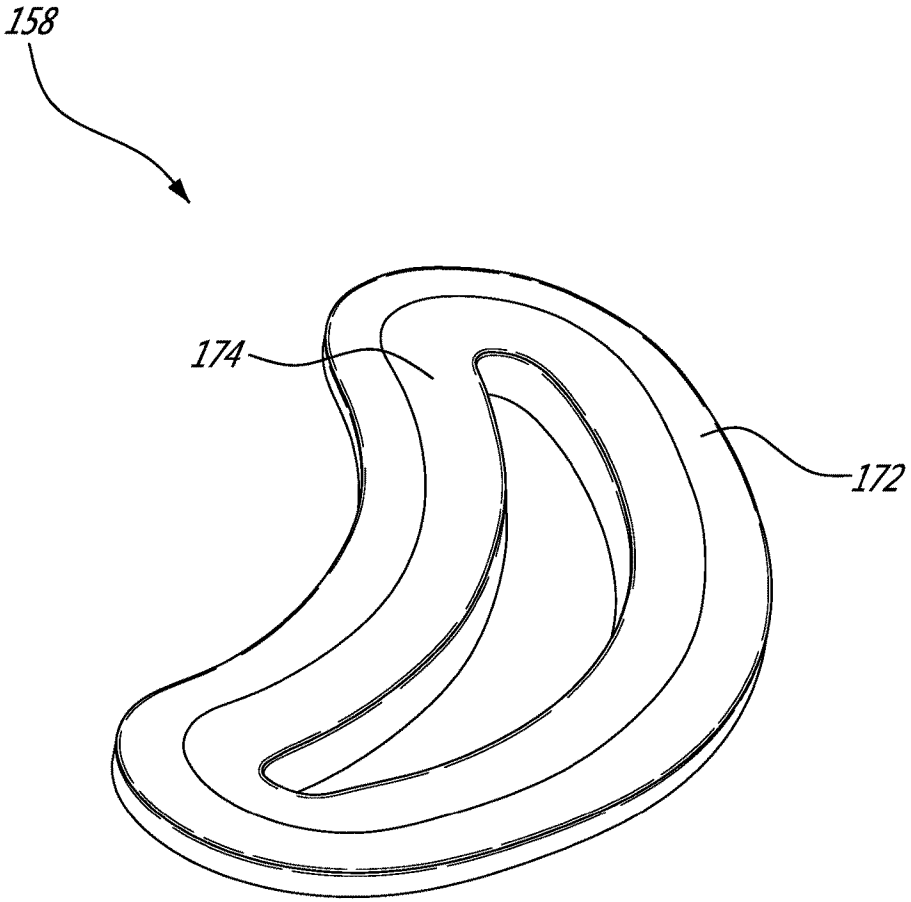
FIG. 3B is a perspective view of the seal spacer of FIG. 3A in accordance with another particular embodiment.

Referring to FIGS. 2, 3A and 3B, the circumferential body 60 has a slot 68 (shown in FIGS. 3A-3B) defined therethrough between the outer surface 62 and the inner surface 64. An inner peripheral surface 70 extends between the outer 62 and inner 64 surfaces around the slot 68. In the embodiment shown, the circumferential body 60 has a shape following a profile of the neck 54, and as such of the airfoil portion 36 of the vane 24. In a particular embodiment, the circumferential body 60 circumscribes the neck 54. In another particular embodiment, the slot 68 is slightly smaller than the neck 54 for press-fitting the seal spacer 58 around the neck 54, relying on the elastomeric properties of the seal spacer 58 as described below.

The circumferential body 60 includes a support 72 and an elastomeric seal portion 74. The support 72 is more resistant to compression set compared to the elastomeric seal portion. In a particular embodiment, the support 72 has a higher compressive strength than the seal portion 74. The support 72 acts as a load limiting device to protect the seal portion 74 by supporting at least a portion of a load exerted on the head 38 when the vane 24 is assembled to the casing wall 20. In a particular embodiment, the support 72 is adapted to space the head 38 away from the casing wall 20 at a predetermined distance, by forming a rigid connection therebetween. The predetermined distance can be slightly smaller than the thickness 66 of the seal spacer 58 to allow compression of the seal portion 74 while minimizing system relaxation of the elastomeric seal portion 74 due to elastomer compression set which may develop when the seal portion is subjected to repeated compression loads. The support 72 may provide fretting protection between the casing wall 20 and the vane 24. Fretting protection can also include protection against wearing and/or abrading by contacting and moving the head 38 against the casing wall 20. In a particular embodiment, the support 72 is made of a stiff and/or rigid material, for example a plastic, thermoplastic or aluminium, such as to maintain the head 38 away from the casing wall 20 at the predetermined distance. In a particular embodiment, the support 72 is made through an injection molding process. In a particular embodiment, the support 72 is an elastomeric support portion of the circumferential body 60.

The seal portion 74 provides sealing between the casing wall 20 and the head 38 in parallel to the rigid support provided by the support 72. In the embodiment shown in FIG. 3A, the seal portion 74 extends laterally outwardly from the support 72 between the outer 62 and inner 64 surfaces such as to surrounds the support 72. In another particular embodiment shown in FIG. 3B, the seal spacer 158 includes the seal portion 174 extending laterally inwardly from the support 172 between the outer 62 and inner 64 surfaces such as to be surrounded by the support 172. In a particular embodiment, the seal portion 74 is made of a flexible material, for example a rubber, a silicon rubber or the like. Therefore, the seal portion 74/174 is made of a material having elastic deformation characteristics, exhibited by a greater resilience than the support 72/172. The seal portion 74 can also be made through an injection molding process. For example, the seal portion 74/174 may be co-molded with the support 72/172. In a particular embodiment, the seal portion 74/174 is stretched so that the vane 24 is passed through the slot 68, and the seal portion 74/174 is released when in place to ensure a sealed engagement therewith. The materials selected for the seal spacer 58 must be capable of sustaining the pressure and temperature of the gas turbine engine 10.

The combination of the two portions 72, 74 forms the circumferential body 60. In a particular embodiment shown, the two portions 72, 74 have a similar shape and are concentric. Alternately, the two portions 72, 74 can be shaped and placed in any other suitable way relative to each other, for example in an eccentric manner. In a particular embodiment, the two portions 72, 74 are shaped to correspond to a shape of the stator vane 24. In a particular embodiment, the two portions 72, 74 are connected together to form a single seal spacer 58, thus facilitating installation of the seal spacer 58. In another particular embodiment, the support 72 and the seal portion 74 are integrally formed into a single monolithic piece.

In use, each seal spacer 58 is installed around the neck 54 of a corresponding vane 24, with the outer surface 62 of the circumferential body 60 resting against the inner pressure surface 28 of the head 38. The vane 24 is then inserted into the casing wall 20, and moved radially inwardly until the inner surface 40 of the head 38 is resting on the outer surface 30 of the casing wall 20 and the vane tip region 34 is engaged with the casing wall 20. The strap 50 is then placed around the casing wall 20 in the strap holder 48 of the head 38 and tightened until the circumferential body 60 of the seal spacer 58 is sufficiently compressed between the inner pressure surface 40 of the head 38 and the outer surface 30 of the casing wall 20 to seal the connection between the head 38 and the casing wall 20. Alternatively or additionally, other ways to load the vanes 24 is considered, such as fasteners for each of the heads 38, as one example.

The seal spacer 58 may thus provide fretting protection between the casing wall 20 and the head 38, where both may be made from metallic parts. The support 72 may limit the load from the strap tension that is applied to the seal portion 74. As such, system relaxation of the seal portion 74 due to elastomer compression set can be reduced or eliminated.

According to a particular embodiment, a method for sealing the gap 56 is used. This method can be used when assembly, inspection and/or maintenance of the engine 10. The seal spacer 58 is disposed within the gap 56. This can be accomplished by placing the seal spacer 58 on the outer case surface 30 to receive the stator vane 24 therein. The radially outer surface 62 of the seal spacer 58 sealingly contacts the inner surface 40 of the head 38 and the radially inner surface 64 of the seal spacer 58 sealingly contacts the outer surface 30 of the casing wall 20. The head 38 is spaced away from the casing wall 20 at the predetermined distance. This can be accomplished, at least partially, by the support 72. In a particular embodiment, the support 72 substantially space the head 38 from the casing wall 20. The load exerted on the head 38 can also be limited by the support 72 in order to reduce the load exerted on the seal portion 74.

The above description is meant to be exemplary only, and one skilled in the art will recognize that changes may be made to the embodiments described without departing from the scope of the invention disclosed. For example, the invention can be applied to any suitable insertable vanes, such as low or high pressure compressors. Still other modifications which fall within the scope of the present invention will be apparent to those skilled in the art, in light of a review of this disclosure, and such modifications are intended to fall within the appended claims.

The invention claimed is:

1. A seal spacer for a gas turbine engine, for providing sealing between a casing wall of the engine and a stator vane inserted into a corresponding opening provided in the casing wall of the engine, the seal spacer comprising:

a circumferential body having a slot defined therethrough configured to receive the stator vane therein, the circumferential body configured to be disposed between and space apart the engine casing wall from a head of the stator vane when the vane is inserted in the slot and the vane is inserted in the opening in the casing wall, the circumferential body defining a first surface adapted to sealingly engage the head of the stator vane and a second surface adapted to sealingly engage the casing wall when the vane is inserted in the slot and the vane is inserted in the opening in the casing wall, wherein the circumferential body includes a support positioned to be engaged and provide a gap between the casing wall and the head when the seal spacer is installed therebetween, and wherein the circumferential body includes an elastomeric seal portion positioned to engage and compressingly provide sealing between the casing wall and the head when the seal spacer is installed therebetween to seal the gap, and wherein the support is made of a material that is different than a material of the elastomeric seal portion, the material of the support being more resistant to compression set than the material of the elastomeric seal portion.

2. The seal spacer as defined in claim 1, wherein the support is made from one of plastic, thermoplastic or aluminum.

3. The seal spacer as defined in claim 1, wherein the seal portion is made from an elastomeric polymer.

4. The seal spacer as defined in claim 1, wherein the support is a plastomeric support portion of the circumferential body.

5. The seal spacer as defined in claim 1, wherein the seal portion extends laterally from the support between the casing wall and the head.

6. The seal spacer as defined in claim 5, wherein the seal portion extends laterally outwardly from the support.

7. The seal spacer as defined in claim 5, wherein the seal portion extends laterally inwardly from the support.

8. The seal spacer as defined in claim 1, wherein the support and the seal portion are integrally formed.

9. The seal spacer as defined in claim 8, wherein the support and the seal portion are comolded into a single monolithic piece.

10. The seal spacer as defined in claim 1, wherein the support and the seal portion are shaped to correspond to a shape of the stator vane.

11. A stator vane assembly for a gas turbine engine, the gas turbine engine comprising an annular casing wall portion defining a duct and having a plurality of openings circumferentially defined therein, the stator vane assembly comprising:

a plurality of stator vanes configured to extend across the duct, each one of the plurality of stator vanes having a head at a radially outer end thereof and configured to protrude through a respective one of the plurality of openings between the casing wall portion and the head, the head extending along a transverse direction relative to a corresponding one of the plurality of stator vanes; and a seal spacer sealingly disposed in the gap between the casing wall portion and the head of a corresponding one of the plurality of stator vanes, the seal spacer having a slot defined therethrough to receive the corresponding one of the plurality of stator vanes, the seal spacer including a support portion disposed between the casing wall and the head, the support portion being configured and sized to define a gap between the head and the casing wall portion, an elastomeric seal portion extending laterally from the support portion and being compressingly disposed between the casing wall portion and the head thereby sealing the gap, and wherein the support portion has a higher compressive strength than the seal portion.

12. The stator vane assembly as defined in claim 11, wherein the support portion is made from one of plastic, thermoplastic or aluminum.

13. The stator vane assembly as defined in claim 11, wherein the seal portion is made from an elastomeric polymer.

14. The stator vane assembly as defined in claim 11, wherein each one of the plurality of stator vanes comprises a neck adapted to be disposed between the casing wall portion and the head and being shaped to correspond to a shape of a corresponding one of the plurality of openings, for receiving a corresponding seal spacer.

15. The stator vane assembly as defined in claim 11, wherein the seal portion extends laterally outwardly from the support portion.

16. The stator vane assembly as defined in claim 11, wherein the seal portion extends laterally inwardly from the support portion.

17. The stator vane assembly as defined in claim 11, wherein the support portion and the seal portion are integrally formed.

18. A method for sealing a gap defined between a casing wall and a head of a stator vane of a gas turbine engine, the method comprising:

disposing a seal spacer within the gap, the seal spacer comprising a support portion and an elastomeric seal portion, the support portion being made from a material that is different than a material of the elastomeric seal portion, the material of the support portion being more resistant to compression set than the material of the elastomeric seal portion;

sealingly contacting a first surface of the seal spacer with an inner surface of the head; and sealingly contacting a second surface of the seal spacer with an outer surface of the casing wall.

19. The method as defined in claim 18, comprising spacing the head away from the casing wall at a predetermined distance.

20. The method as defined in claim 18, comprising limiting a load applied to the seal portion with the support portion.

* * * * *